US005425002A

United States Patent [19]

Plisek et al.

[11] Patent Number: 5,425,002

[45] Date of Patent: Jun. 13, 1995

[54] ACOUSTIC PRESSURE PULSE GENERATOR

[75] Inventors: Franz Plisek, Erlangen; Benedikt Hartinger, Nuremberg, both of Germany

[73] Assignee: Siemens Aktiengesellschaft, Munich, Germany

[21] Appl. No.: 150,990

[22] Filed: Nov. 12, 1993

[30] Foreign Application Priority Data

Dec. 14, 1992 [DE] Germany ..... 42 42 131.4

[51] Int. Cl.[6] ..... H04R 23/00

[52] U.S. Cl. ..... 367/175; 367/185; 181/173; 181/172; 181/157; 181/148; 128/662.03; 381/193; 381/202

[58] Field of Search ..... 367/182, 185, 175; 181/148, 166, 157, 171, 172, 173; 381/192, 193, 202; 128/662.03

[56] References Cited

U.S. PATENT DOCUMENTS

| | | | |
|---|---|---|---|
| 4,980,873 | 12/1990 | Gross et al. | 367/181 |
| 5,022,084 | 6/1991 | Shinjo | 181/161 |
| 5,283,836 | 2/1994 | Trufitt | 381/199 |

FOREIGN PATENT DOCUMENTS

| | | |
|---|---|---|
| 3009125 | 10/1981 | Germany . |
| 3742500 | 6/1989 | Germany . |
| 4133327 | 8/1992 | Germany . |

*Primary Examiner*—J. Woodrow Eldred
*Attorney, Agent, or Firm*—Hill, Steadman & Simpson

[57] ABSTRACT

An apparatus for generating acoustic pressure pulses in an acoustic medium has a membrane that can be driven which adjoins the acoustic medium and which is driven in an impact-producing manner. The membrane is mechanically pre-stressed so that it returns into its initial position after a pressure pulse is generated.

16 Claims, 3 Drawing Sheets

ACOUSTIC PRESSURE PULSE GENERATOR

BACKGROUND OF THE INVENTION

1. Field Of the Invention

The present invention is directed to an apparatus for generating acoustic pressure pulses in an acoustic propagation medium of the type having a membrane that adjoins the acoustic propagation medium and is driven in an impact-producing manner.

2. Description Of the Prior Art

An electromagnetic embodiment of a pressure pulse generator of the above general type is disclosed by German OS 37 42 500. The pressure pulse source employed in this pressure pulse generator is composed of an electrically conductive membrane and a flat coil adjacent thereto. The flat coil is connected to a voltage supply that contains a capacitor charged to several kV. The capacitor is caused to discharge suddenly across the coil, and the discharge current flowing therein builds up a magnetic field extremely rapidly. This field in turn simultaneously induces a current opposite that of the coil in the membrane which, consequently, generates an opposing magnetic field under whose influence the membrane is moved suddenly away from the coil. The resulting pressure pulse, for example, can be employed for the non-invasive disintegration of calculi situated in the body of a patient or can be employed for the non-invasive treatment of pathological tissue.

In order to achieve a high efficiency, i.e. an optimally complete conversion of the input electrical energy into pressure pulse energy, it is necessary to have the membrane lie flat against the coil. It must also be guaranteed that the membrane returns into its initial position after the generation of a pressure pulse before the next pressure pulse is generated. This, for example, can ensue, as disclosed in German OS 37 42 500, by evacuating the space between membrane and the flat coil during manufacture of the pressure pulse source, and hermetically sealing this space by suitable means. In the medical application of standard pressure pulse systems, the acoustic propagation medium such as, for example, water is usually circulated for cooling and for eliminating air bubbles that disturb the propagation of the shock waves. When a pressure pulse generator is positioned above a water supply reservoir, an under-pressure in comparison to the atmosphere occurs in the acoustic propagation medium corresponding to the height difference between the pressure pulse source and the supply reservoir. This under-pressure leads to tensile forces that pull the membrane away from the coil under certain circumstances, even given evacuation of the space between the membrane and the coil. If the space between the membrane and the coil is not absolutely tight relative to the surrounding atmosphere, this can lead to the formation of an air pillow in this space. If a larger air pillow forms in this way over an adequately long time span, then the air also remains enclosed when the pressure pulse generator is again located under the supply reservoir in the meantime, i.e. when the normal pressure again prevails in the acoustic propagation medium. Due to the loss in electromagnetic energy occurring as a consequence of the air pillow, the functioning of the pressure pulse source is thus no longer assured. Further, given a longer-lasting influence of tensile forces, a plastic material deformation of the membrane can occur, this destroying the reproducibility of the pressure pulses that is extremely important for the application. Moreover, the evacuation and hermetic sealing of the intervening space involve considerable technological outlay. The occurrence of an under-pressure in the acoustic propagation medium compared to the intervening space can be prevented according to German OS 41 33 327 by maintaining the closed space wherein the acoustic propagation medium is located at a static pressure that is elevated in comparison to the ambient pressure. In this case, however, the cooling of the acoustic propagation medium and the elimination of air bubbles that occur during the application must be resolved in some other way, which may require increased technological outlay under certain circumstances.

SUMMARY OF THE INVENTION

An object of the present invention is to provide a pressure pulse generator of the type generally described above wherein it is assured that the membrane lies on the shock-excitation system before the generation of a pressure pulse, as is the return of the membrane into its initial position after the generation of a pressure pulse, both with little technological outlay, when the side of the membrane facing away from the acoustic propagation medium is at a higher pressure than prevails in the acoustic propagation medium.

This object is inventively achieved in an acoustic pressure pulse generator wherein the membrane is mechanically pre-stressed such that it returns into its initial position after a pressure pulse is generated. As a consequence of the fact that the membrane is built into the pressure pulse source under a mechanical pre-stress, the membrane returns into its initial position after every pressure pulse and lies on the shock-excitation system in the time span between two pulses. When the acoustic propagation medium is circulated and given an unfavorable position of the pressure pulse generator relative to its supply reservoir, by contrast to the prior art, the tensile forces in the inventive apparatus caused by the under-pressure in the acoustic propagation medium relative to the side of the membrane facing away from the medium can neither pull the membrane away from the shock-excitation system nor plastically deform it, since this is opposed by spring forces caused by the mechanical pre-stress of the membrane. Hermetic sealing of the acoustic propagation medium from the environment under excess pressure, which causes the aforementioned problems regarding cooling and elimination of air bubbles, and thus results in higher technological outlay and shorter maintenance intervals, can likewise be avoided.

Although a membrane vibrator for a vibration conveyor is disclosed in German OS 30 09 125 having a membrane which returns to its initial position after an excursion under the influence of elastic forces that arise due to the excursion of the membrane, a mechanical pre-stress of the membrane is not present in that known apparatus.

In one embodiment of the invention the mechanical pre-stress of the membrane is achieved by fixing the edge of the membrane so that the membrane lies against the shock-excitation system. It is preferably provided that the membrane arcs toward the shock-excitation system—at least before being assembled into the pressure pulse source—and is pressed against the shock-excitation system along its edge. This assures that the membrane assumes a defined initial position before a pressure pulse is generated, lying against the shock-excitation system in this initial position, and is returned into this initial position after a pressure pulse is generated.

In a preferred embodiment of the invention, the membrane is a component of the shock-excitation system. It then contains an electrically conductive material and can be electromagnetically driven in an impact-producing manner by a flat coil lying opposite it. The mechanical pre-stress of the membrane can be achieved in that the edge of the membrane is fixed such that the membrane, at least outside its edge, lies against the pancake coil. Preferably the membrane is arced toward the coil before assembly and the mechanical pre-stress is achieved by pressing the membrane against the coil along its edge.

The space between the membrane and the shock-excitation system or the coil in another embodiment of the invention can be permanently closed from the environment in order to prevent the penetration of air into this space from the vary outset. In a further embodiment of the invention, the space can be at ambient pressure. In accord with another embodiment of the invention, the space can be evacuated in order to prevent lifting of the membrane off of the shock-excitation system (or off of the coil) .as well as to assure the return of the membrane to its initial position after a pressure pulse is generated, even under the aforementioned unfavorable conditions.

A durable closing of the space between the membrane and the shock-excitation system or the flat coil, however, is not absolutely necessary. According to a further embodiment of the invention, on the contrary, in order to further reduce the technological outlay, the space between membrane and the shock-excitation system (or the coil) is connected to the surrounding atmosphere via one or more openings, so that air that may enter into this space can subsequently escape therefrom. In a further embodiment of the invention, valve means are provided that, in the manner of a check valve, allow gas to escape from the space but do not allow it to flow back thereinto. This offers the advantage that air that has once been removed from the space can no longer proceed back into this space when the membrane is repelled.

DESCRIPTION OF THE PREFERRED EMBODIMENTS

Figure 1:
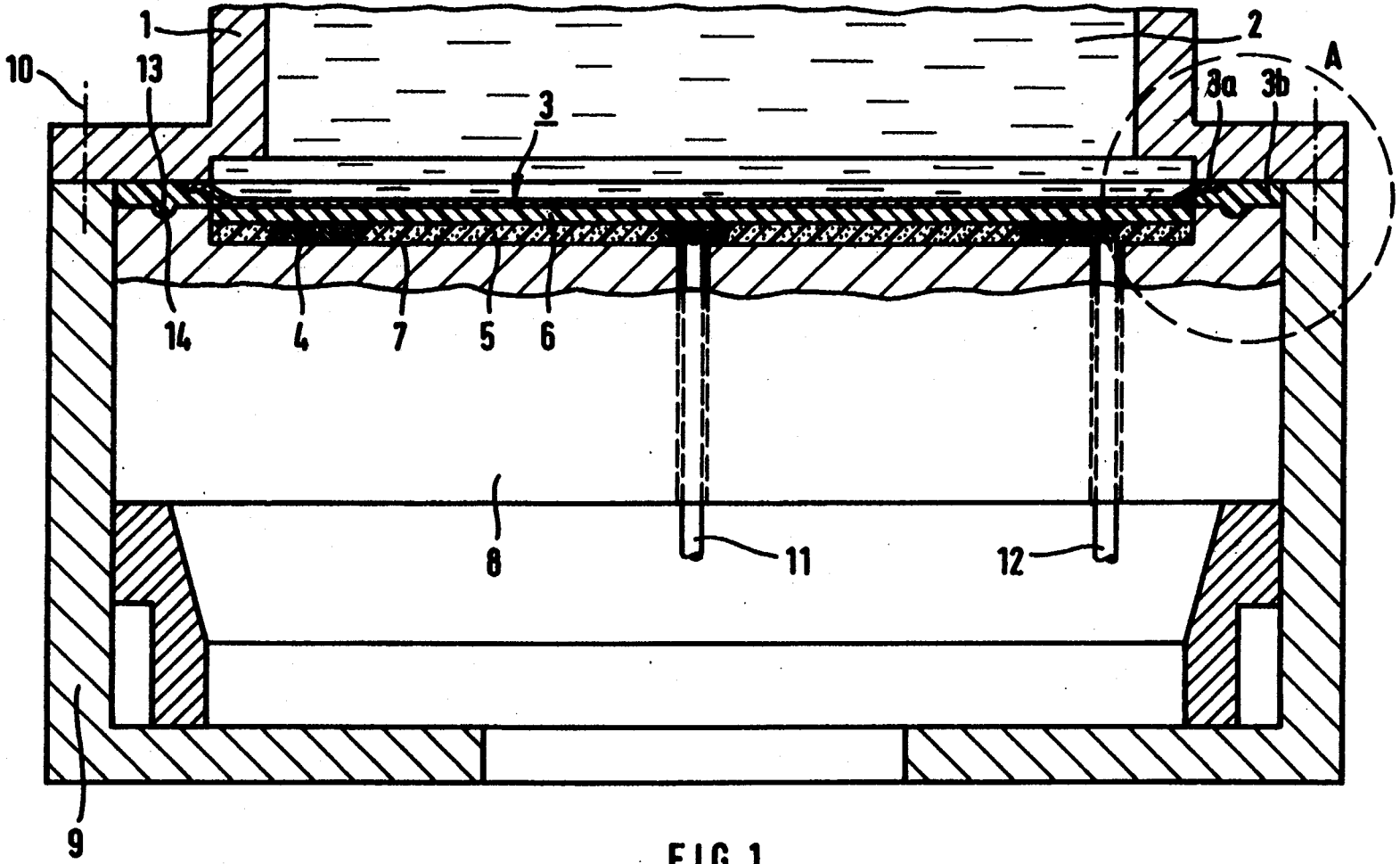
FIG. 1 is a longitudinal section through a pressure pulse generator of the invention.

The pressure pulse generator of the invention illustrated in FIG. 1 has a housing 1 that contains an acoustic propagation medium 2 such as, for example, a water volume and is closed by a membrane 3. The electromagnetically driveable membrane 3 is composed of a metallic disc 3*a* that, for example, is formed of aluminum and an edge part 3*b* formed of an elastically resilient material, whereby the disc 3*a* is joined, for example by vulcanizing, to the edge part 3*b*. The membrane 3 is located opposite a flat coil 4 having spirally arranged turns, only a few thereof being shown in FIG. 1. For fixing, the coil 4 is surrounded by an insulating compound 5, for example a casting resin. In order to preclude voltage arcing from the coil 4 to the membrane 3, an insulating foil 6 against which the membrane 3 lies is glued onto the surface of the insulating compound 5 that faces toward the back side of the membrane 3. The coil 4 in the insulating compound 5 that surrounds it and the glued-on insulating foil 6 are accepted into a centering recess 7 of a coil carrier 8 formed of insulating material, that is in turn accepted into a cap 9 that is connected to the housing 1 with screws 10 indicated by dot-dash lines. The terminals 11 and 12 of the coil 4 lead through openings in the coil carrier 8 to a high-voltage supply (not shown) that supplies current surges (pulses) to the coil 4 for the electromagnetic repulsion of the membrane 3. As a result, the membrane 3 is suddenly driven in the way initially set forth, causing a pressure pulse to be introduced into the acoustic propagation medium 2.

Figure 2:
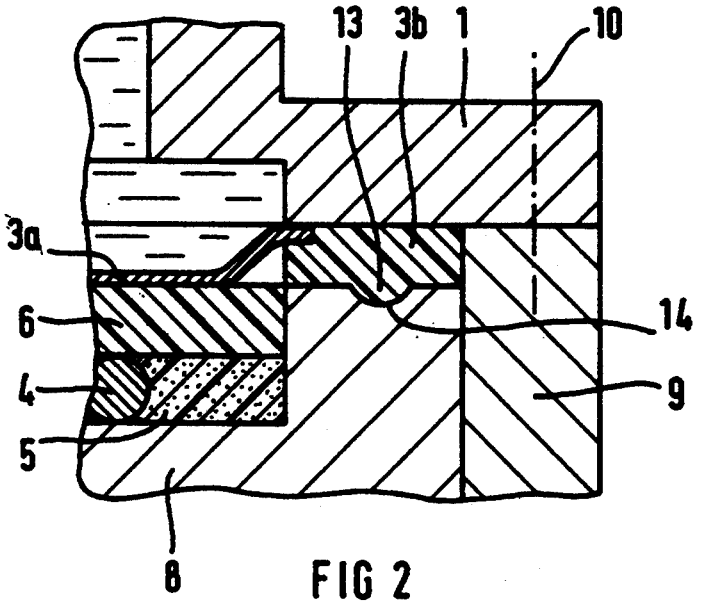
FIGS. 2 through 4 respectively show enlarged views of detail A of FIG. 1 for three different embodiments of the invention.

In the embodiment of the invention shown in FIG. 1, the space between the membrane 3 and coil 4 is hermetically sealed from the surrounding atmosphere. According to FIG. 2, a continuous bead 13 is applied around the entirety of the edge part 3*b* of the membrane 3 for this purpose. The bead 13 engages into a corresponding channel 14 of the coil carrier 8 and is clamped between the housing 1 and tile cap 9 with the screws 10. An hermetic seal both relative to the surrounding atmosphere and relative to the acoustic propagation medium 2 is thereby assured. Dependent on the manufacturing method, ambient pressure or—following prior evacuation—a vacuum prevails in the space between the membrane 3 and the coil 4.

Figure 3:
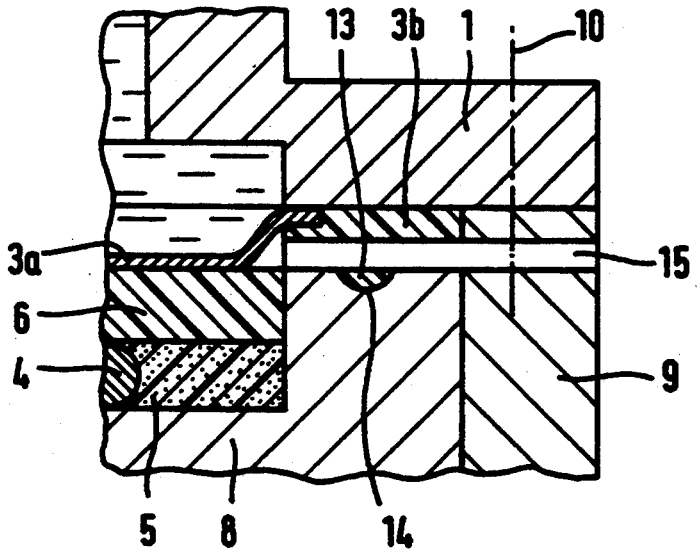

As already mentioned, the space between the membrane 3 and the coil 4 need not necessarily be durably closed, due to the measures provided by the invention. FIG. 3 shows detail A (from FIG. 1) of an alternative embodiment of the invention wherein the edge part 3*b* and the cap 9 are provided with one or more openings 15 that lead into the space between the membrane 3 and the coil 4, so that air that has entered into this space can escape. This prevents an air cushion, which considerably deteriorates the efficiency of the pressure pulse generator for the aforementioned reasons from forming. Such an air pillow forms because of leaky locations over a longer time span, given an under-pressure prevailing in the acoustic propagation medium 2 compared to the side of the membrane 3 facing away from the acoustic propagation medium and given the influence of the tensile forces associated therewith on the membrane 3.

Figure 4:
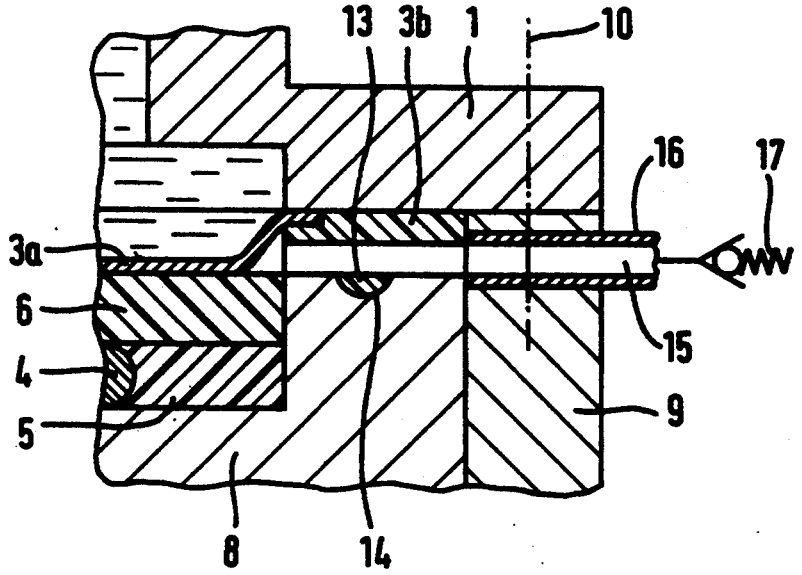

FIG. 4 shows the detail A in a further embodiment of the invention, whereby the opening 15 is provided with a line 16 and a schematically illustrated check valve 17 attached thereto so that air can escape from the space between the membrane 3 and the coil 4 upon return of the membrane 3 into its initial position, but can no longer flow back into the space upon generation of a pressure pulse when the membrane 3 is repelled from the flat coil 4.

Figure 5:
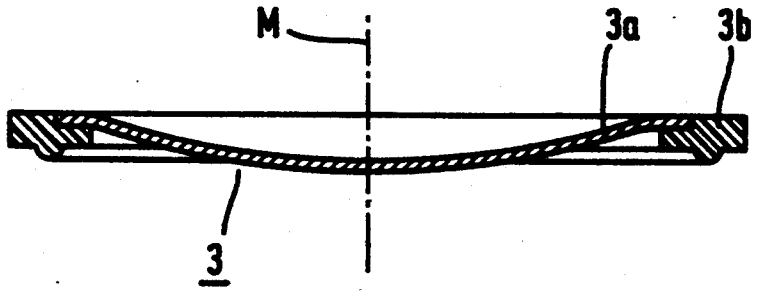
FIG. 5 is a longitudinal section through the membrane of the invention before being built into the pressure pulse generator.

FIG. 5 shows the membrane 3 before being built into the pressure pulse generator. The disc 3*a* of the membrane 3 is slightly arced in accord therewith but is flatly pressed against the coil 4, or against the insulating foil 6 glued thereon by the screws 11 in the built-in condition and is thereby mechanically pre-stressed, so that the membrane 3 returns to its initial position after the generation of a pressure pulse due to the internal elastic forces.

The membrane 3 of FIG. 5 has an approximately spherical arc that is rotationally symmetrical relative to an axis M. Other arc geometries, for example an elliptical arc, are possible.

In the embodiments of the invention described herein, the shock-excitation system is operated electromagnetically. Other shock-excitation systems, for example pneumatic or percusive, are also possible.

Although modifications and changes may be suggested by those skilled in the art, it is the intention of the inventors to embody within the patent warranted hereon all changes and modifications as reasonably and properly come within the scope of their contribution to the art.

We claim as our invention:

1. An acoustic pressure pulse generator comprising:

a housing containing an acoustic propagation medium;

a membrane disposed in said housing for interacting with said acoustic propagation medium, said membrane prior to disposition in said housing having an arced region in an arced state;

excitation means for driving said membrane in an impulse-producing manner to introduce an acoustic pressure pulse into said acoustic propagation medium, said membrane being disposed in an initial position prior to being driven; and means for maintaining said membrane under a mechanical pre-stress when disposed in said housing for causing said membrane to return to said initial position after each generation of a pressure pulse by mechanically deforming said arced region and forcing said arced region to assume a substantially flat state.

2. An acoustic pressure pulse generator as claimed in claim 1 wherein said membrane has a peripheral edge surrounding a central region of said membrane, wherein said central region comprises said arced region, and wherein said means for maintaining said membrane under a mechanical pre-stress comprises means for fixing said peripheral edge of said membrane in said housing with said central region of said membrane forced against said excitation means.

3. An acoustic pressure pulse generator as claimed in claim 1 wherein said membrane has a peripheral edge surrounding a central region, wherein said central region comprises said arced region, and wherein said means for maintaining said membrane under a mechanical pre-stress comprises means for affixing said peripheral edge of said membrane in said housing with said central region arced toward said excitation means.

4. An acoustic pressure pulse generator as claimed in claim 3 wherein said membrane is spherically arced.

5. An acoustic pressure pulse generator as claimed in claim 3 wherein said membrane is elliptically arced.

6. An acoustic pressure pulse generator as claimed in claim 1 wherein said excitation means includes a coil, and wherein said membrane contains electrically conductive material for electromagnetically interacting with said coil.

7. An acoustic pressure pulse generator as claimed in claim 6 wherein said membrane has a peripheral edge surrounding a central region, wherein said central region comprises said arced region, and wherein said means for maintaining said membrane under a mechanical pre-stress comprises means for affixing said peripheral edge of said membrane in said housing with said central region of said membrane pressing against said coil.

8. An acoustic pressure pulse generator as claimed in claim 6 wherein said membrane has a peripheral edge surrounding a central region, wherein said central region comprises said arced region, and wherein said means for maintaining said membrane under a mechanical pre-stress comprises means for affixing said peripheral edge of said membrane in said housing with said central region of said membrane arced toward and against said coil.

9. An acoustic pressure pulse generator as claimed in claim 8 wherein said membrane is spherically arced.

10. An acoustic pressure pulse generator as claimed in claim 8 wherein said membrane is elliptically arced.

11. An acoustic pressure pulse generator as claimed in claim 1 wherein said membrane and said excitation means have a space therebetween which is closed from the environment.

12. An acoustic pressure pulse generator as claimed in claim 11 wherein ambient pressure prevails in said space.

13. An acoustic pressure pulse generator as claimed in claim 11 wherein said space is evacuated.

14. An acoustic pressure pulse generator as claimed in claim I wherein said membrane and said excitation means have a space therebetween, and wherein said housing has at least one opening communicating said space with the surrounding atmosphere outside said housing.

15. An acoustic pressure pulse generator as claimed in claim 1 wherein said membrane and said excitation means have a space therebetween and further comprising one-way valve means for permitting gas to escape from said space to an exterior of said housing.

16. An acoustic pressure pulse generator as claimed in claim I wherein said membrane has a peripheral edge surrounding a central region of said membrane, wherein said central region comprises said arced region, and wherein said means for maintaining said membrane under a mechanical pre-stress comprises means acting exclusively on said peripheral edge of said membrane for forcing said central region of said membrane to assume said substantially flat state.

* * * * *